United States Patent [19]

Beale

[11] 3,977,287

[45] Aug. 31, 1976

[54] FABRIC CUTTING BLADE

[75] Inventor: Charles Beale, Belmont, Mich.

[73] Assignee: General Motors Corporation, Detroit, Mich.

[22] Filed: Dec. 22, 1975

[21] Appl. No.: 642,701

[52] U.S. Cl. ..... 83/697
[51] Int. Cl.[2] ..... B26D 1/06
[58] Field of Search ..... 83/697, 835

[56] References Cited

UNITED STATES PATENTS

| | | | |
|---|---|---|---|
| 1,098,579 | 6/1914 | Lewis | 83/697 |
| 2,010,009 | 8/1935 | Brightwell | 83/697 |
| 3,682,034 | 8/1972 | Pearl | 83/697 X |

*Primary Examiner*—Willie G. Abercrombie
*Attorney, Agent, or Firm*—Charles E. Leahy

[57] ABSTRACT

A cutting blade for cutting a multi-layer stack of fabric sheets comprises a relatively flat elongated blade body having a leading edge and a trailing edge. The leading edge of the blade body has a knife edge for cutting through the multi-layer stack of fabric sheets as the cutting blade is moved forwardly into the stack. A bevelled tip is provided on the cutting blade for cutting through the fabric sheets as the blade makes a downstroke through the stack. The bevelled tip has a leading point at the leading edge of the blade and a trailing tip at the trailing edge of the blade. The leading tip pierces the top sheet of the stack and defines a rearward facing upwardly angled cutting edge which imparts a forward acting force on the blade to balance the rearward acting force imparted to the cutting blade by the forward cutting movement of the leading edge as the cutting blade moves forwardly through the stack. The trailing tip at the trailing edge of the blade defines a forward facing upwardly angled cutting edge which trails the knife edge and the leading tip and is effective to sever unsevered trailing fabric threads.

3 Claims, 7 Drawing Figures

FABRIC CUTTING BLADE

The invention relates to a cutting blade and more particularly to an improved fabric cutting blade for a numerically controlled vertically reciprocable cutting machine for cutting a multi-layer stack of fabric sheets.

The modern manufacture of seat covers, clothing and other fabric products utilizes vertically reciprocable cutting machines for cutting through a multi-layer stack of fabric sheets. These cutting machines are guided along a set path over the stack of fabric sheets by a numerical control system.

A cutting blade mounted in the cutting machine conventionally has a knife edge on the leading edge of the blade for cutting through the stack of fabric as the blade is moved forwardly into the stack. It is also known to provide a bevelled tip on the end of the blade for cutting through the fabric as the reciprocating blade makes a downstroke through the stack. It is known that a blade for cutting through a vinyl fabric performs effectively when the bevelled tip has a leading tip which defines a rearward facing upwardly angled cutting edge. This rearwardly facing upwardly angled cutting edge imparts a forward acting force on the blade as the blade makes a downstroke through the fabric, thereby balancing a rearward acting force imparted to the blade by the forward cutting movement of the leading edge as the blade moves forwardly into the stack.

It is also known that a cloth fabric is best cut by a cutting blade having a trailing tip at the trailing edge of the blade which defines a forward facing upwardly angled cutting edge which trails the knife edge and is effective to sever trailing threads. However, this conventional blade for cutting a cloth fabric has been limited in its forward feed rate and in its rate of reciprocation as well as fabric stack height because of a high incidence of blade breakage because of unbalanced rearward forces acting on the blade.

A further disadvantage of the prior art fabric cutting blades is that the cutting action tends to move the material as the blade is moved forwardly into the stack.

The present invention provides a cutting blade for cutting a multi-layer stack of fabric sheets and comprises a relatively flat elongated blade body having a leading edge and a trailing edge. The leading edge of the blade body has a knife edge for cutting through the multi-layer stack of fabric sheets as the cutting blade is moved forwardly into the stack. A bevelled tip is provided on the cutting blade for cutting through the fabric sheets as the blade makes a downstroke through the stack. The bevelled tip has a leading point at the leading edge of the blade and a trailing tip at the trailing edge of the blade. The leading tip defines a rearward facing upwardly angled cutting edge which imparts a forward acting force on the blade to balance the rearward acting force imparted to the cutting blade by the forward cutting movement of the leading edge as the cutting blade moves forwardly through the stack. The trailing tip at the trailing edge of the blade defines a forward facing upwardly angled cutting edge which trails the knife edge and the leading tip and is effective to sever any unsevered trailing fabric threads.

These and other objects, advantages and features of the invention will become apparent upon consideration of the specification and the appended drawings in which.

Figure 1:
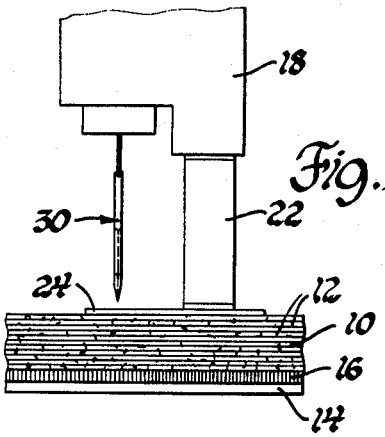
FIG. 1 is an elevation view of a numerically controlled vertically reciprocable cutting machine in which the cutting blade of this invention is used.

Referring to FIG. 1, a stack 10 of fabric sheets is comprised of a plurality of individual cloth sheets 12. The multi-layer stack 10 is supported by a table 14 which has a plurality of closely arranged and vertically upstanding bristles 16. A vertically reciprocable cutting machine 18 is mounted over the table by a track assembly, not shown, which is controlled by a numerical control system for moving the cutting machine 18 along a desired set path over the table 14. Cutting machine 18 has a leg 22 which mounts a foot 24 which is lightly spring loaded against the top sheet of the stack 10. A cutting blade 30, of this invention, is mounted in the cutting machine 18 and is reciprocated by the cutting machine 18 while simultaneously being driven forwardly along the set path by the numerical control system.

Figure 2:
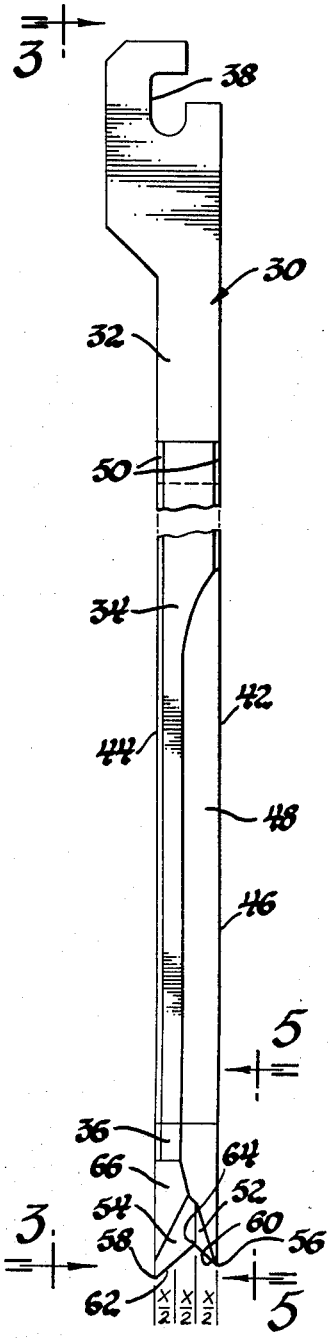
FIG. 2 is a side elevation view of the cutting blade of the invention.

Referring to FIG. 2, the cutting blade 30 is seen to be comprised of a shank portion 32, a body portion 34, and a tip portion 36. The shank portion 32 has a recess 38 at its upper end which is adapted for mating engagement with a chuck provided in the cutting machine 18. The shank portion 32 is suitably soldered to the body portion 34. The body portion 34 is preferably of a suitable tool steel and is suitably soldered integrally with the tip portion 36. The tip portion 36 is preferably constructed of a carbide steel, for example, Kennametal Carbide K-68.

Figure 4:
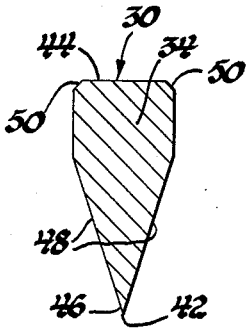
FIG. 4 is a sectional view taken in the direction of arrows 4—4 of FIG. 3.
Figure 5:
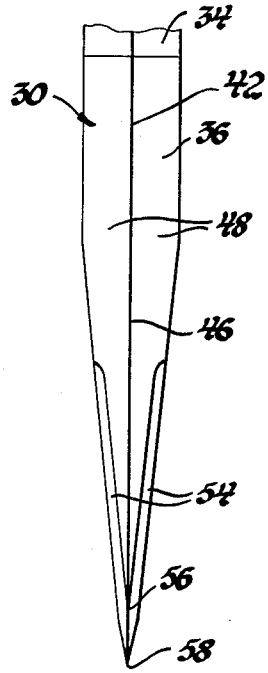
FIG. 5 is a fragmentary frontal elevation view of the cutting blade taken in the direction of arrows 5—5 of FIG. 2.
Figure 3:
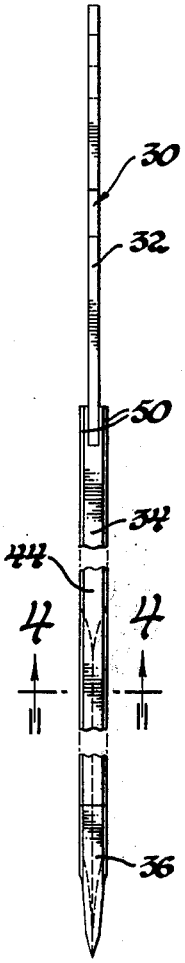
FIG. 3 is a view taken in the direction of arrows 3—3 of FIG. 2.

As best seen in FIGS. 2, 3, and 4, the body portion 34 and tip portion 36 of the cutting blade 30 have a leading edge 42 and a trailing edge 44. The leading edge 42 has a knife edge 46 which is formed by ground bevelled surfaces 48 provided on both sides of the cutting blade 30. The knife edge 46 cuts through the stack of fabric sheets 10 as the cutting machine 18 is moved along the path defined by the numerical control system. The corners 50 of the cutting blade 30 are chamfered.

Figure 6:
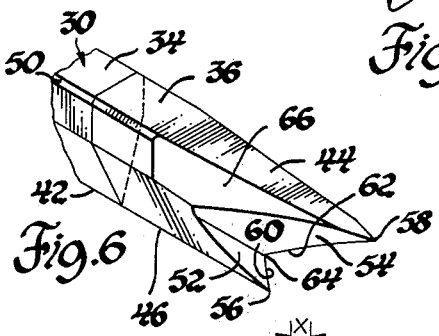
FIG. 6 is a perspective view of the tip of the blade.

As seen in FIGS. 2 and 6, facets 52 and 54 are ground into both sides of the tip portion 36 and define a leading tip 56 and a trailing tip 58. The facets 52 and 54 also define a rearward facing upwardly angled cutting edge 60 adjacent the leading tip 56 and a forwardly facing upwardly angled cutting edge 62 adjacent the trailing tip 58. As best seen in FIG. 2, the cutting edges 60 and 62 define a downwardly facing notch, having an apex 64. The cutting edges 60 and 62 are preferably inclined at equal angles relative the horizontal plane of stack 10. Transition facets 66 on both sides of the blade provide a transition between the facets 54 and the contours of the bevelled surfaces 48 and the body of the blade.

Figure 7:
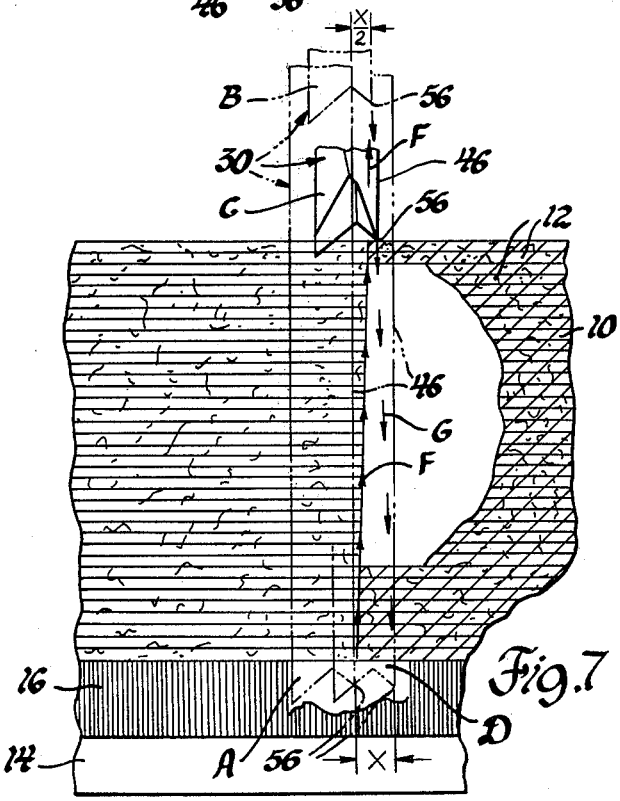
FIG. 7 shows how the cutting blade functions to cut a multi-layer stack of fabric sheets.

Referring to FIG. 7, there is shown the manner in which the cutting blade 30 cuts the stack 10 of fabric sheets 12. Referring to FIG. 7, it is seen that the cutting blade 30 reciprocates between a phantom-line indicated terminal downstroke position designated A, a phantom-line indicated terminal upstroke position designated B, a solid line indicated initial-cutting downstroke position designated C, and a terminal phantom-line downstroke position designated D.

As the cutting blade 30 makes a complete stroke from its terminal downstroke position A to its next subsequent terminal downstroke position D, it is seen that the leading tip 56 follows first an upward path designated by arrows F and then a downward path designated by arrows G. These paths F and G which are followed by the leading tip 56 are inclined and slightly curvilinear due to the simultaneous reciprocating movement and forward movement of the cutting blade 30 relative the stack 10.

As the cutting blade 30 makes its upstroke from the terminal downstroke position A, it is seen that the knife edge 46 slices through the stack 10. As the leading tip 56 moves upwardly, it is simultaneously moving forwardly so that the knife edge 46 cuts the stack 10 at all layers leftwardly of the path F and the layers to the right of the path F remain unsevered. The cutting of the fabric is of course terminated when the leading tip 56 reaches the upper surface of the stack 10 and then continues its upstroke to the terminal upstroke position B. The cutting blade 30 continues to move forwardly relative the stack even though the tip portion 36 of the cutting blade 30 has been withdrawn from the stack 10. Accordingly, when the cutting blade 30 reaches its initial cutting downstroke position designated C, the tip 56 will have moved forwardly of the upstroke cutting path F so that the leading tip 56 pierces into the top surface of the stack 10 at a point somewhat forwardly of the cutting path F. This piercing of the leading tip 56 into the top surface of the stack 10 serves to hold the stack 10 from being moved horizontally during the initiation of the cutting downstroke.

As the downstroke reciprocation of the cutting blade 30 progresses from the position C to the terminal downstroke position D, the leading tip 56 follows the path designated G. It is seen that the knife edge 46 slices through the stack 10 all along its length as the cutting blade 30 moves forwardly. Simultaneously, during the downstroke reciprocation through approximately the upper one-half of the stack 10, the unsevered fabric positioned leftwardly of the path G is severed by the rearward facing upwardly angled cutting edge 60 adjacent the leading tip 56. As the cutting blade continues to pierce through approximately the lower one-half of the stack height, the forwardly facing upwardly angled cutting edge 62 also cuts through the stack 10 and the notch formed by the cutting edges 60 and 62 traps the fabric to assure its severance. When the tip of the blade reaches its terminal downstroke position D the cutting edges 60 and 62 have both entered into the bristles 16 thereby assuring that even the bottom-most fabric sheet 12 of the stack 10 has been severed.

Referring to FIGS. 2 and 7, it will be seen that the dimensions of the cutting blade 30 and the path of motion of leading tip 56 are described by designated multiples of the dimension X. It has been found that the dimensional characteristics of the cutting blade 30 are related to the cutting rate according to the following formula:

$$\frac{\text{minutes}}{\text{reciprocation of the blade}} \times \frac{\text{forward feed}}{\text{minutes}} = X$$

For example, using this formula, a feed rate of 600 inches of forward movement per minute and a rate of blade reciprocation of 2400 cycles per minute, the dimensions X of the cutting tip is determined as follows.

$$\frac{1 \text{ minute}}{2400 \text{ cycles}} \times \frac{600 \text{ inches}}{\text{minute}} = \tfrac{1}{4} \text{ inch}$$

Referring again to FIG. 7, it is seen that the above cutting rates of 600 inches per minute and 2400 cycles per minute results in a blade having an overall width of ⅜ inches with the distance from the leading tip 56 to the apex 64 being ⅛ inch as measured on a horizontal projection and the distance from the apex 64 to the trailing tip 58 being ¼ inch as measured on a horizontal projection. Accordingly, since the cutting blade 30 moves forwardly ¼ inch during a complete reciprocal movement from the terminal downstroke position A to the terminal downstroke position D the ⅛ inch width of the cutting edge 60 and the adjacent leading ⅛ inch width portion of the cutting edge 62 are effective to sever the material during the downstroke of the blade along the path G. Simultaneously, at least the trailing ⅛ inch width of the cutting edge 62 is available to sever any trailing threads which escaped complete severance during the preceding cycle of reciprocation of the blade.

Referring to FIG. 7, it will be understood that the amount by which the leading tip 56 advances forwardly of the upstroke cutting path F as shown in the solid-line initial cutting position designated C is determined by the ratio of the stack height to the overall stroke of the blade. It has been found that effective cutting performance is provided when the stack height is about three inches and the blade stroke is about four inches between its terminal downstroke position A and upstroke position B.

What is claimed is:

1. A blade for cutting a multi-layer stack of fabric sheets comprising: a relatively flat elongated blade body having a leading edge and a trailing edge, the leading edge of the blade body having a knife edge for cutting through the multi-layer stack of fabric sheets as the blade is moved forwardly into the stack, a bevelled tip on the blade body for cutting through the fabric sheets as the blade makes a downstroke through the stack, said bevelled tip having a leading tip at the leading edge of the blade and a trailing tip at the trailing edge of the blade, the leading tip defining a rearward facing upwardly angled cutting edge which imparts a forward acting force on the blade to balance a rearward acting force imparted to the blade by the forward cutting movement of the leading edge through the stack, the trailing tip at the trailing edge of the blade defining a forward facing upwardly angled cutting edge which trails the knife edge and is effective to sever trailing threads.

2. A cutting blade for use in a vertically reciprocable cutting machine movable along a set path over a multi-layer stack of fabric sheets, of less height than the reciprocable stroke of the cutting machine, said cutting blade comprising: a relatively flat elongated blade body having a leading edge and a trailing edge, the leading edge of the blade body having a knife edge for cutting through the multi-layer stack of fabric sheets as the blade is moved forwardly into the stack, a bevelled tip on the blade body for cutting through the fabric sheets as the blade makes a downstroke through the stack, said bevelled tip having a leading tip at the leading edge of the blade and a trailing tip at the trailing edge of the blade, the leading tip piercing into the top of the fabric stack during the downstroke to hold the fabric from being moved, a rearward facing cutting edge angled upwardly from the leading tip to impart a forward acting force on the blade to balance a rearward acting force imparted to the blade by the forward cutting movement of the leading edge through the stack, and a forward facing cutting edge on the bevelled tip angled upwardly from the trailing tip, said upwardly angled rearward facing cutting edge and upwardly angled forward facing cutting edge cooperating to define a notch-like configuration for trapping the fabric during the downstroke.

3. A cutting blade for use in a vertically reciprocable cutting machine movable along a set path over a multi-layer stack of fabric sheets, of less height than the reciprocable stroke of the cutting machine, said cutting blade comprising: a relatively flat elongated blade body having a leading edge and a trailing edge, the leading edge of the blade body having a knife edge for cutting through the multi-layer stack of fabric sheets as the blade is moved forwardly into the stack, a bevelled tip on the blade body for cutting through the fabric sheets as the blade makes a downstroke through the stack, said bevelled tip having a leading tip at the leading edge of the blade and a trailing tip at the trailing edge of the blade, the leading tip piercing into the top of the fabric stack during the downstroke to hold the fabric from being moved, a rearward facing cutting edge angled upwardly from the leading tip to impart a forward acting force on the blade to balance a rearward acting force imparted to the blade by the forward cutting movement of the leading edge through the stack, and a forward facing cutting edge on the bevelled tip angled upwardly from the trailing tip, said upwardly angled rearward facing cutting edge and upwardly angled forward facing cutting edge cooperating to define a notch-like configuration for trapping the fabric during the downstroke, and the length of the rearward facing cutting edge as measured on a horizontal projection being about one-half the length of forward movement of the blade during a complete stroke and the length of the forward facing cutting edge as measured on a horizontal projection being about equal to the length of forward movement of the blade during a complete stroke, the forward facing cutting edge being effective to sever trailing threads.

* * * * *